United States Patent [19]

Silva

[11] Patent Number: 4,686,831

[45] Date of Patent: Aug. 18, 1987

[54] SYSTEM AND METHOD OF DELIVERING LOW/PRESSURE/LOW TEMPERATURE FLUIDS INTO HIGH PRESSURE/HIGH TEMPERATURE HEAT EXCHANGERS BY MEANS OF ALTERNATE PRESSURE EQUALIZATION

[76] Inventor: Robert E. Silva, 6452 N. 8th, Fresno, Calif. 93710-4302

[21] Appl. No.: 866,268

[22] Filed: May 23, 1986

Related U.S. Application Data

[63] Continuation-in-part of Ser. No. 648,980, Dec. 18, 1984, abandoned.

[51] Int. Cl.[4] ..... F01K 13/00

[52] U.S. Cl. ..... 60/645; 60/692; 165/104.22; 417/207

[58] Field of Search ..... 165/104.22, 1; 126/433; 417/207, 208, 209; 60/692, 645

[56] References Cited

U.S. PATENT DOCUMENTS

| | | | |
|---|---|---|---|
| 4,128,123 | 12/1978 | Garriss et al. | 165/104.22 |
| 4,366,853 | 1/1983 | Bernier | 165/104.22 |

FOREIGN PATENT DOCUMENTS

| | | | |
|---|---|---|---|
| 32247 | 3/1978 | Japan | 60/692 |
| 14812 | 2/1981 | Japan | 60/692 |
| 32017 | 4/1981 | Japan | 60/692 |

*Primary Examiner*—Albert W. Davis, Jr.

[57] ABSTRACT

Apparatus and method are disclosed for controlling fluid delivery into a heat exchanger wherein the temperature and the pressure of the delivered fluid is lower than the temperature and the pressure of the fluid within the heat exchanger and wherein the delivery of the fluid is accomplished without the use of pumps or compressors or other such devices. The delivering apparatus uses the pressure force developed within the heat exchanger after fluid change of phase has occurred therein for delivering the fluid vapor resulting therefrom to an elevation superior to the delivering apparatus by means of a predetermined elevated position of the pressure driven device using the vaporized fluid for its operation and the disposition of the conduit delivering the exhaust therefrom. The exhausted fluid is returned to the liquid condition by means of the heat and pressure expended in operating the pressure driven device and, by additional cooling, if needed. Means are provided for automatically returning the condensed liquid fluid to the heat exchanger by alternately isolating and pressurizing the fluid in alternative containers wherefrom the fluid is delivered in a compound manner into an additional container for further subjection to pressure equalization and controlled delivery into the said heat exchanger. This is accomplished in a closed system on a continuous basis with the energy force above described as the sole source of energy required to continue the cycle with the exception of an insignificant amount of electricity used to operate the solenoid control devices.

3 Claims, 3 Drawing Figures

SYSTEM AND METHOD OF DELIVERING LOW/PRESSURE/LOW TEMPERATURE FLUIDS INTO HIGH PRESSURE/HIGH TEMPERATURE HEAT EXCHANGERS BY MEANS OF ALTERNATE PRESSURE EQUALIZATION

This application is a continuation-in-part of application Ser. No. 648,980, now abandoned, filed Dec. 18, 1984.

BACKGROUND OF THE INVENTION

This invention relates generally to devices and methods for converting fluids from a low pressure condition, in the liquid state, into a high pressure condition, in the vapor state, by increasing the fluid temperature sufficiently to cause the fluid to change phase from the liquid state into the vapor state and, more specifically, to devices and methods which accomplish this end without utilization of externally powered pumping apparatus.

It is well known that considerable energy is expended to force fluids at a given pressure into a chamber wherein fluids at a higher pressure exist. It is also well known that fluids at a higher pressure may be used to produce work. The invention hereinafter described eliminates the need for pumps, compressors, convection equipment or similar devices to transfer low pressure fluids into a heat exchanger, or a heat exchanging system, containing fluids, which by reason of an increase in their temperature, have a higher pressure. Many types of fluid can be utilized by the invention as well as any accessible source of heat having sufficient temperature to cause change of phase in the fluid wherein the resulting vapor pressure has the required pressure to perform work of a given energy requirement.

A storage tank for receiving and delivering a supply of fluid in the liquid state is disposed at an elevation sufficiently higher than the invention whereby the liquid can flow from the storage tank into alternating liquid delivering tanks, one at a time, so that, as one tank is being filled the alternate tank is being emptied. The storage tank is in pressure equilibrium with the atmosphere through venting conduit means. The storage tank is provided with an inlet conduit means for receiving liquid from the source of liquid and, with a float valve means for controlling the liquid input from the source of liquid such that a predetermined level of liquid is maintained in the storage tank. The storage tank is connected to the lower disposed alternating tanks by valve controlled conduit means. Liquid is delivered from the bottom part of the storage tank into the top part of the alternating tanks such that as one alternating tank is being filled the other alternating tank is closed to venting and liquid input and opened to high pressure vapor input from the heat exchanger whereby vapor pressure equilibrium exists between the heat exchanger, the liquid flow control tank and the alternating tank being emptied. All pressures being equal between the alternating tank being emptied, the heat exchanger and the liquid flow control tank now permits the liquid to migrate from the higher disposed alternating tank being emptied through the one way check valve disposed on the delivering conduit between the alternating tank being emptied and the liquid flow control tank, and into the liquid flow control tank, as is permitted by a float valve disposed in the liquid flow control tank. Vapor venting conduit is provided between the storage tank and the alternating tanks to permit atmospheric pressure equilibrium to exist between the atmosphere, the storage tank and the alternating tank being filled. A two way automatic valve disposed on the venting conduit is opened to the alternating tank being filled and closed to the alternating tank being emptied.

A two way automatic valve disposed on the liquid delivering conduit between the storage tank and the alternating tanks is opened to the alternating tank being filled and closed to the alternating tank being emptied. A two way automatic valve disposed on the high pressure vapor conduit between the heat exchanger and the alternating tanks is closed to the alternating tank being filled and opened to the alternating tank being emptied.

In this manner the liquid is allowed to migrate from the storage tank into the alternating tank being filled and, from the alternating tank being emptied the liquid is allowed to migrate into the liquid flow control tank as the liquid flow control tank in turn delivers the liquid into the heat exchanger.

The liquid flow control tank is in flow communication with the heat exchanger by means of open conduit interconnecting the lower part of the liquid flow control tank with the lower part of the heat exchanger and an open conduit interconnecting the upper part of the liquid flow control tank with the upper part of the heat exchanger and the high pressure vapor conduit serving the alternating tanks. In this manner the liquid flow control tank is continually in liquid equilibrium and vapor pressure equilibrium with the heat exchanger and alternately in pressure equilibrium with the alternating tank being emptied. As the liquid in the liquid flow control tank and the heat exchanger is used to perform work the float valve in the liquid flow control tank is opened to allow replacement of the used liquid.

The heat exchanger and the liquid flow control tank are so positioned that the desired liquid level in the heat exchanger is equal to the liquid level established and maintained by the float valve disposed in the liquid flow control tank. The operating level of liquid in the liquid flow control tank and the heat exchanger provides for a predetermined volume of liquid and of vapor to co-exist in the two chambers in constant equilibrium with each other.

A source of electricity of sufficient voltage and amperage to operate the automatic valves is controlled by means of an electrical circuit control consisting of an on-off switch and an alternating relay control interconnected to high pressure probe sensors which detect liquid levels in the alternating tanks and the liquid flow control tanks such that, when the probe sensors are in contact with the liquid, a current of electricity is conducted by the liquid to complete an electrical circuit which is in communication with the relay control. The first alternating tank is provided with three probe sensors disposed in a manner that detects predetermined high and low levels of the liquid. The probes are insulated from the metal tank by high temperature ceramic. A filled level is detected by a horizontally placed probe whereby a signal is sent to the relay to alter the electric current contact with one set of terminals such that the current is closed to those terminals and current contact is established with a second set of terminals whereby the automatic valves controlling the liquid input, venting and high pressure vapor conduits are reversed and the alternate filling and emptying mode is activated. The current is then held by a long vertically disposed probe sensor which maintains the filling mode until the liquid level is lowered to the predetermined low level which is just below the reach of the vertical probe. When the liquid contact with the vertical probe is lost the signal is relayed back to the first set of terminals and the filling mode is again switched. A horizontally disposed probe sensor placed at the low position in the tank now controls the current until the tank is again filled and the top horizontal probe is again contacted and the filling and emptying cycle is continued. The continuation of the alternating filling and emptying cycle is dependent upon continued liquid and electrical input. The rate of liquid consumption by the produced work determines the rate of alternation of the filling and emptying cycle. The heat exchanger is in communication with the pressure driven turbine generator, and the emptying alternating tank and the liquid flow control tank by high pressure vapor conduit means. The exhausted vapor from the turbine generator is fed into a condenser wherein it is returned to the liquid state and returned to the storage tank for r ecycling. The invention may be used to produce other work wherein the need for the pressure driven turbine generator and the vapor condenser is excluded. Direct application of the produced pressure to other forms of work may include pressurized liquid transport, steam injection systems, co-generation plants, liquification of air, desalinization of sea water under high pressure conditions wherein the high pressure evaporate is used to produce electricity, waste water reclamation and many other applications.

SUMMARY OF THE INVENTION

In this invention, fluid in the liquid state, at atmospheric temperature and pressure is supplied to an atmospherically vented storage tank, at a location reasonably accessible to the invention and disposed at an elevation consistent with the gravity requirements of the invention. The fluid is delivered from the storage tank, in the liquid state, under alternating conditions, into a plurality of chambers disposed lower than the storage tank. The storage tank is provided with an inlet conduit for receiving fluid from the source of fluid and, with an internal float valve means to control the liquid level therein and, to control the rate of fluid input from the source of fluid.

The alternating tanks, or chambers, are isolated, one at a time, from high pressure equilibrium with the lower disposed liquid flow control tank and heat exchanger and, at the same time, opened to atmospheric pressure equilibrium with the storage tank by automatic valve means. The liquid can migrate from the higher storage tank into the lower alternating tank to be filled when the vapor within the said tank is open to venting in the above mentioned manner. The automatic valve so disposed on the venting conduit is provided with one inlet and two outlets. One outlet is connected to the top part of one alternating tank by conduit means and the other outlet is connected to the top part of the other alternating tank by conduit means. A liquid delivering conduit is connected to the bottom part of the storage tank at one end and to an automatic valve at the other end. One outlet of the automatic valve is connected by conduit means to the top part of one alternating tank and the other outlet is so connected to the top part of the other alternating tank. A high pressure vapor conduit is interconnected to the heat exchanger and the liquid flow control tank and then travelled to an elevation above the alternating tanks where it is connected to the inlet of an automatic valve having two outlets. One outlet of the automatic valve is connected by conduit means to the top part of one alternating tank and the other outlet is connected by conduit means to the top part of the other alternating tank. The liquid in the alternating tank being emptied is allowed to migrate into the lower disposed liquid flow control tank when the said tank is closed to atmospheric equilibrium with the storage tank and, is closed to liquid input from the storage tank and, is opened to high pressure vapor equilibrium with the heat exchanger and the liquid flow control tank. While one alternating tank is being filled the other alternating tank is being emptied.

The electrically activated valves controlling the filling/emptying modes of the alternating tanks are controlled by liquid level sensing probes disposed in the alternating tanks. These probes send electric signals to a relay switch which in turn sends signals to the automatic valves to switch positions when the alternating tank containing the probes is filled and, to switch back to the original position when the said tank is empty.

The alternating tanks are connected to the liquid flow control tank by conduit means. Each alternating tank is connected to a check valve by the conduit means which is disposed between the bottom part of the alternating tank and the liquid flow control tank. The check valve provides for liquid flow from the alternating tanks but will not permit the liquid to flow back into the tanks. A "T" shaped conduit connects the check valves to the liquid flow control tank. A float valve disposed in the liquid flow control tank controls the rate of liquid input from the alternating tank being emptied. The float valve also establishes and maintains a predetermined liquid level in the liquid flow control tank. This established liquid level is reflected in the heat exchanger such that, as the liquid is converted into high pressure vapor and used to produce outside work, the consumed liquid is replaced by the liquid flow control tank through the controlling action of the float valve therein.

The alternate filling and emptying cycle is dependent upon atmospheric pressure equilibrium between the storage tank and the alternating tank being filled and high pressure vapor equilibrium between the alternating tank being emptied and the liquid flow control tank and the heat exchanger. The liquid flow control tank is in liquid equilibrium with the heat exchanger by means of open flow conduit interconnecting the two chambers at the bottom part thereof. The liquid flow control tank is continually in high pressure vapor equilibrium with the heat exchanger by open conduit means.

In a preferred embodiment of the invention, the produced high pressure vapor is available to the work and to the internal operation of the invention at the same time. When the produced work constitutes the operation of a turbine generator a condensing apparatus is provided between the pressure driven turbine and the storage tank for receiving and condensing the spent exhaust vapor into the liquid state for return to the storage tank. In addition, a venting conduit is disposed on the conduit connecting the condenser and the liquid flow control tank which provides atmospheric equilibrium to the condenser, the storage tank and the alternating tank being filled.

In an additional preferred embodiment of the invention, a liquid sensing probe is disposed in the top part of the second alternating tank for sending a signal to the relay to reverse the filling/emptying mode in the event of operational failure of any part of the apparatus which might result in both tanks being filled at one time. The reversed delivering mode will then require that the second alternating tank be emptied before the normal mode can be resumed.

In accordance with another aspect of the invention, a probe sensor is disposed in the top part of the liquid flow control tank for sending a signal to the on-off switch to stop current contact with the high pressure on-off valve disposed between the source of high pressure vapor and the alternating tanks to thereby stop liquid delivery into the liquid flow control tank until such time as the liquid level therein is again normal.

It is a major object of this invention to provide such a system and method for introducing fluids of a given low pressure into a heat exchanger wherein the fluid pressure is increased to an amount sufficient to produce work and wherein this invention may be employed to introduce the said fluids into the heat exchanger without the use of a pump, compressor or other injection device.

It is a further object of this invention to provide such an apparatus and method wherein a portion of the produced high pressure fluid vapor is accessible to the heat exchanger, the liquid flow control tank and the liquid delivering alternating tank for establishing high pressure equilibrium therein such that the otherwise isolated alternating tank can deliver liquid therefrom into the lower disposed liquid flow control tank by means of specific gravity forced migration, all pressures being equal.

It is an additional object of this invention to provide such an apparatus and method wherein the outside atmospheric pressure is accessible to the storage tank, the alternating tank being filled and the condenser, if any, for establishing atmospheric pressure equilibrium therein such that the otherwise isolated alternating tank being filled can receive the liquid from the higher disposed storage tank by means of gravity force migration, all pressure therein being equal.

It is a further object of the invention to provide such a system and method wherein one alternating tank is being filled with liquid from a higher disposed storage tank while, at the same time, the other alternating tank is being emptied of liquid into a lower disposed liquid flow control tank.

It is still another object of the invention to provide such a system and method wherein when one alternating tank is being isolated from venting and liquid input the other alternating tank is being opened to venting and liquid input.

It is yet another object of the invention to provide such a system and method wherein, when one alternating tank is being opened to atmospheric pressure equilibrium with the storage tank, the other alternating tank is being opened to high pressure vapor equilibrium with the liquid flow control tank and the heat exchanger.

It is a further object of the invention to provide such an apparatus and method wherein the storage tank is higher than the alternating tanks and the alternating tanks are higher than the liquid flow control tank such that the liquid can migrate from the higher tank into the lower tank when the higher tank and the lower tank are in open flow communication in the liquid delivering conduit and in pressure equilibrium through the vapor delivering conduit.

It is an additional object of the invention to provide such a system and method wherein the liquid delivering conduits disposed in the bottom part of the alternating tanks are each supplied with a check valve whereby the liquid flow from the said tanks cannot be reversed.

It is a further object of the invention to provide such a system and method wherein the liquid level in the liquid flow control tank is in equilibrium with the liquid level in the heat exchanger such that, when the liquid level in the heat exchanger is lowered a predetermined amount, a float valve disposed in the controler tank is caused to open and thereby release pressure against the liquid input conduit for operating to accept liquid input from the alternating tank being emptied until such time that the liquid level in the heat exchanger and the liquid flow control tank is increased to the predetermined operating level.

It is another object of the invention to provide such a system and method wherein the top part of the liquid flow control tank is coupled by conduit means to the top part of the heat exchanger for operating to establish and maintain high pressure vapor equilibrium on a constant basis between the upper part of the heat exchanger and the upper part of the liquid flow control tank.

It is a further object of the invention to provide such a system and method wherein the predetermined maximum liquid levels in the alternating tanks, the liquid flow control tank and the heat exchanger is such that a predetermined volume of vapor must occupy the remaining interior area of the said chambers.

It is an additional object of the invention to provide such an apparatus and method wherein high pressure probe sensors, three way automatic valves and alternating electric relay controls are utilized in combination communication for operating to alternately fill, pressurize, empty and vent the alternating tanks.

It is yet another object of the invention to provide such an apparatus and method wherein the high pressure vapor being produced by the heat exchanger is delivered to produce outside work and, at the same time, the produced high pressure vapor is made available to the internal operation of the invention to provide high pressure equilibrium between the heat exchanger, the liquid flow control tank and the alternating tank being emptied.

It is an additional object of the invention to provide such an apparatus and method wherein the vaporous exhaust of the pressure driven turbine generator is condensed into the liquid state at such an elevation that the liquid output of the condenser is higher than the storage tank whereby the liquid condensate will flow into the storage tank by gravity.

In accordance with another aspect of the invention, automatic valve apparatus is provided between the storage tank and the alternating tanks for opening the liquid delivering conduit to the alternating tank being filled and closing the liquid delivering conduit to the alternating tank being emptied.

In accordance with another aspect of the invention, automatic valve apparatus is provided between the storage tank and the alternating tanks for opening the alternating tank being filled to venting conduit connecting the top parts of the alternating tanks with the top part of the storage tank and for closing the alternating tank being emptied to the said conduit.

In accordance with another aspect of the invention, automatic valve apparatus is provided between the alternating tanks and the high pressure vapor conduit for opening to deliver high pressure vapor equilibrium to the alternating tank being emptied and closing to delivery of said vapor to the alternating tank being filled.

It is another object of the invention to provide such an apparatus and method wherein input conduit attached to the storage tank has access to the source of liquid as needed to maintain the liquid level therein, as fluid is lost to venting during the filling and emptying cycle of the alternating tanks.

It is yet another object of the invention to provide such a system and method wherein the liquid from the source of liquid is admitted into the storage tank by float valve means to maintain a desired liquid level therein.

The above features of the invention provide for progressive migration of the low pressure fluid from the storage tank into the heat exchanger.

It is to be understood that the above described arrangements are only illustrative of the application of the principles of the invention. Numerous modifications and alternative arrangements may be devised by those skilled in the art without departing from the spirit and scope of the present invention. The operation of the pressure driven turbine as is disclosed in the specifications and the detailed description of the drawings is only one of many possible applications of the pressure force resulting from the use of the invention and any other application of the pressure force to produce outside work resulting from the use of the invention in the above described manner, or any other manner, whether or not the work involves a pressure driven turbine, is intended to be included and covered by this disclosure of the specifications, drawings and the detailed description of the drawings herein included.

BRIEF DESCRIPTION OF THE DRAWINGS

The above and other objects of the invention will become apparent from a consideration of the following detailed description of the drawing presented in connection with the accompanying drawings in which.

DETAILED DESCRIPTION OF THE DRAWINGS

Figure 1:
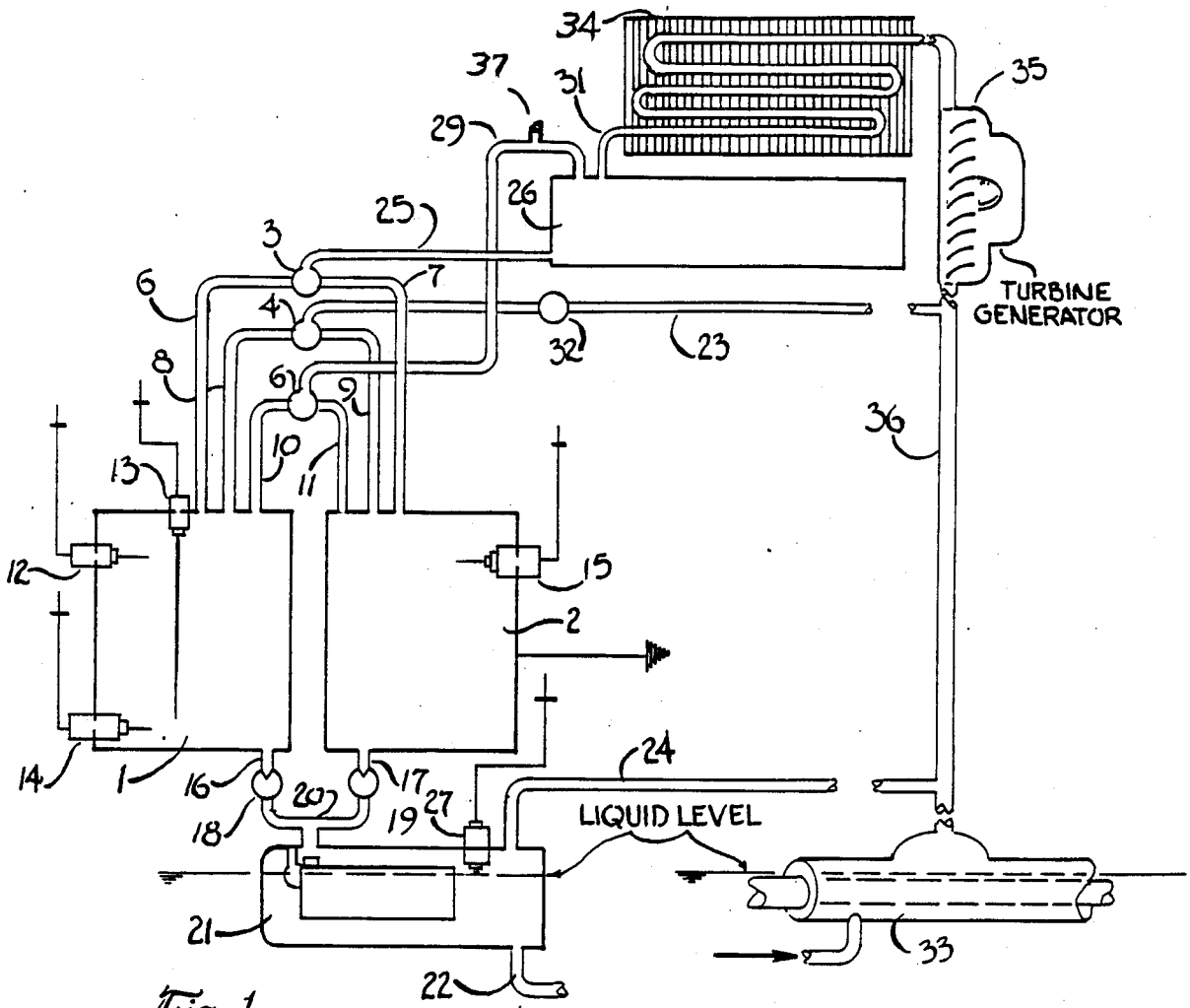
FIG. 1 is a schematic representation of an alternating and vented fluid delivering system made in accordance with the principles of the present invention.

Referring to FIG. 1 there is shown a specific illustrative embodiment of the present invention used in connection with a conventional pressure driven turbine generator 35, a vapor condenser 34 having a liquid delivering conduit 31 which is provided with an attached venting conduit 37. When the heat exchanger 33 is being operated, heat is transferrred from the source of heat into the heat exchanger 33. Liquid is delivered into the heat exchanger 33 to a predetermined high level illustrated in the cross section in FIG. 1. The liquid is converted into the liquid state and delivered into the high pressure conduit 36. The high pressure conduit 36 is interconnected with the conduit 24 and the conduit 23 and the pressure driven turbine generator 35. The turbine generator 35 receives the high pressure vapor at a given pressure and converts the pressure into electricity whereby the pressure and the temperature of the said vapor is lowered a predetermined amount. The spent vapor is exhausted from the turbine generator 35 into the vapor condenser 34. The fluid delivery system includes a supply of liquid from the source of liquid via the inlet conduit 49 which is attached to the top part of the storage tank 26. The storage tank 26 is provided with a float valve 50 which regulates the liquid input from the source of liquid to thereby establish and maintain a predetermined high liquid level in the storage tank 26. The vapor condenser 34 delivers the condensed fluid into the storage tank 26 via the conduit 31 to be recycled continuously.

Figure 3:
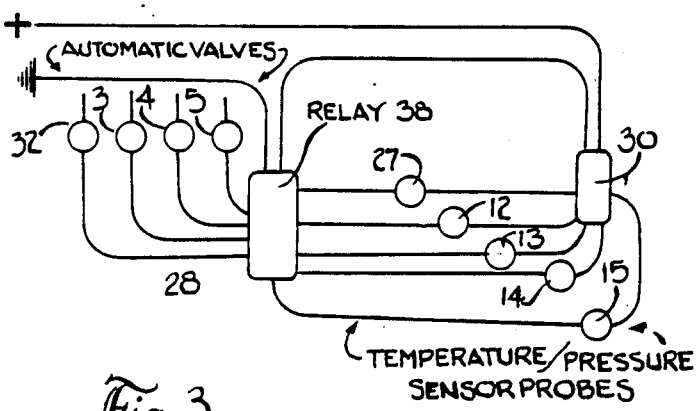
FIG. 3 is a schematic representation of the electrical wiring diagram 28 for use in conjunction with the apparatus shown in FIG. 1.
Figure 2:
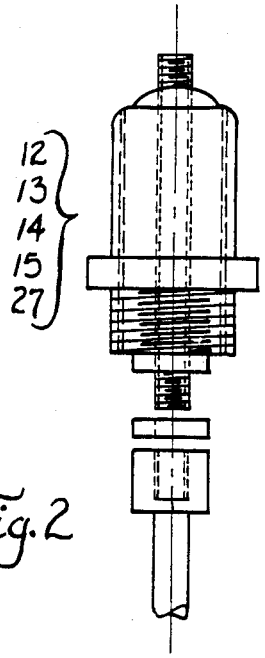
FIG. 2 is a schematic representation of the high temperature/high pressure probe sensors 12, 13, 14, 15 and 27 of FIG. 1.

A source of heat and a source of electricity is included in the system. The electricity is used to operate the on-off switch 30, the automatic relay 38, the probes 12, 13, 14, 15 and 27 and the on-off valve 32 referred to in the diagram 28 shown in FIG. 3 of the drawing.

The condenser 34 is disposed higher than the storage tank to provide for gravity differential between the condenser 34 and the storage tank 26, and the disposition of the connecting conduit 31. The venting conduit 37 located on the conduit 31 provides access to atmospheric equlibrium (venting) pressure to the condenser 34, the storage tank 26, the conduit 29, the automatic valve 5 and the conduit 10 and the alternating tank 1, or, the conduit11 and the alternating tank 2, depending upon which alternating tank, 1 or 2, is being filled. The conduit 25 delivers the liquid from the storage tank 26 into the automatic valve 3 which in turn delivers the liquid into the conduit 6 and the alternating tank 1, or, into the conduit 7 and the alternating tank 2, depending upon the filling mode. The alternating tanks 1 and 2 are disposed lower than the storage tank 26 to provide for gravity forced migration of the liquid from the storage tank 26 into the lower disposed alternating tanks 1 or 2. The conduits 6, 8 and 10 are connected to the top part of the alternating tank 1 and, the conduits 7, 9 and 11 are connected to the top part of the alternating tank 2. The conduit 6 is connected to one outlet of the automatic valve 3 and the conduit 7 is connected to the other outlet of the automatic valve 3. The conduit 8 is connected to one outlet of the automatic valve 4 and the conduit 9 is connected to the other outlet of the automatic valve 4. The conduit 10 is connected to the automatic valve 5 at one outlet and the conduit 11 is connected to the automatic valve 5 at the other outlet. The liquid in the storage tank 26 can migrate into the alternating tank 1 when the conduit 25, the automatic valve 3 and the conduit 6 are open to liquid flow communication and the conduit 29, the automatic valve 5 and the conduit 10 are in open vapor flow communication at the same time, and the automatic valve 4 and the conduit 8 are closed. The liquid in the storage tank 26 can migrate into the alternating tank 2 when the conduit 25, the automatic valve 3 and the conduit 7 are open to liquid flow communication and the conduit 29, the automatic valve 5 and the conduit 11 are in open vapor flow communication at the same time and the conduit 9 and the automatic valve 4 are closed to high pressure input into the alternating tank 2.

When alternating tank 1, or 2, is being filled by gravity means with the liquid from the storage tank 26 the residual vapor therein is displaced by heavier liquid and vented from the alternating tank 1, or 2, being filled via the conduit 10, or 11, the automatic valve 5 and the conduit 29 into the storage tank 26 and out of the conduit 31 and the conduit vent 37.

When alternating tank 1, or 2, is being emptied by gravity means the liquid therefrom is delivered into the liquid flow control tank 21 which is disposed lower than the alternating tanks 1 and 2 to provide liquid level differential between the two levels and, to provide room for delivering and controlling apparatus between the two levels. The "T" shaped conduit 20 provides a common input which is shared by the alternating tanks 1 and 2. The lower end of the "T" conduit 20 is attached to the top part of the liquid flow control tank 21 and travelled upwards such that the check valve 18 is connected to one end of the "T" and the check valve 19 is connected to the other end of the "T" configuration. The conduit 16 interconnects the top part of the check valve 18 to the bottom part of the alternating tank 1. The conduit 17 interconnects the top part of the check valve 19 to the bottom part of the alternating tank 2. The alternating tank 1, or 2, being emptied is opened to high pressure vapor equilibrium with the liquid flow control tank 21 and the heat exchanger 33 by the automatic valve 4 via the conduit 23, the conduit 36 and the conduit 24. The on-off valve 32 is normally open and can be considered a part of the conduit 23. The conduit 8 delivers the high pressure vapor from the automatic valve 4 to the alternating tank 1 when it is being emptied and the conduit 9 delivers the high pressure vapor from the automatic valve 4 to the alternating tank 2 when it is being emptied. The liquid in the alternating tank 1, or 2, being emptied is thereby subjected to high pressure vapor equilibrium with the liquid flow control tank 21 and the heat exchanger 33 and can now migrate from the alternating tank 1, or 2 being emptied into the lower liquid flow control tank 21 subject to float valve 39 regulation, all pressures being equal and the liquid levels being unequal.

The liquid flow control tank 21 is in liquid level equilibrium with the heat exchanger 33 whereby the liquid level established and maintained by the float valve 39 is reflected by means of open flow communication through the conduit 22 interconnecting the bottom part of the liquid flow control tank 21 with the bottom part of the heat exchanger 33 thereby providing reflected high pressure vapor equilibrium in the upper part of the liquid flow control tank 21 and the upper part of the heat exchanger 33 established by means of the common liquid level therein and the common vapor level therein. Continued application of heat to the heat exchanger 33 provides a continuous work producing cycle with but a small loss of energy due to the venting process.

The probe sensor 27 is disposed vertically in the top part of the liquid flow control tank 21 for detecting any undesired increase in liquid level therein. The activation of the probe 27 by liquid level increase sends a signal to the on-off switch 30 to close the on-off valve 32 disposed on the conduit 23 which in turn denies high pressure vapor equilibrium to the alternating tank 1 or 2 being emptied until such time that the liquid level in the liquid flow control tank 21 is lowered to the desired operating level.

One end of the conduit 24 is disposed in the top part of the liquid flow control tank 21 and the other end is attached to the lower end of the conduit 36. The lower end of the conduit 36 is disposed in the top part of the heat exchanger 33. The conduit 36 is travelled upward where, at a predetermined distance, it is intersected by the conduit 23, and is then travelled further to be connected to the intake of the turbine generator 35. The heat exchanger 33 can now provide high pressure vapor equilibrium between the liquid flow control tank 21 via the conduit 24, the conduit 36, the conduit 23 and the alternating tank 1 or 2 being emptied via the automatic valve 4 since the high pressure vapor produced by the heat exchanger 33 is delivered into the conduit 36. The conduit 22 is connected to the bottom part of the liquid flow control tank 21 at one end of the said conduit 22 and the other end is connected to the bottom part of the heat exchanger 33 for operating to provide liquid level equilibrium between the liquid flow control tank 21 and the heat exchanger 33.

The above discussed liquid level co-existing between the liquid flow control tank 21 and the heat exchanger 33 is maintained by the controlling action of the float valve 39 and an area of vapor storage therein is provided by this arrangement, such that both liquid and high pressure vapor equilibrium co-exists between the liquid flow control tank 21 and the heat exchanger 33.

The alternating tank 1 is provided with the probe sensor 13 which is disposed vertically in the top part of the tank 1 for operating to maintain electrical contact with the liquid therein as the liquid is lowered from a filled condition to an empty condition whereby the emptying mode signal is continued to the relay 38 (shown in the diagram 28 of FIG. 3) until such time that the liquid level is lowered below the reach of the said probe 13 whereby the signal to the relay 38 is lost to the emptying mode and switched to the filling mode which is held in place by the probe 14, until the liquid level is raised to the level monitored by the probe 12. When the probe 12 is contacted the signal to the relay 38 is again reversed and the emptying mode is again in force.

When the relay 38 is switched to the emptying mode by liquid contact with the probe 12 the automatic valve 3 is signalled to close liquid input to the conduit 6 and open to liquid input to the conduit 7 whereby the alternating tank 1 is closed to liquid input and the alternating tank 2 is opened to liquid input. The automatic valve 4 is signalled by the emptying mode of the relay 38 to close to high pressure vapor input to conduit 9 and open to high pressure vapor input to conduit 8 whereby the alternating tank 1 is opened to high pressure vapor input and the alternating tank 2 is closed to high pressure vapor input. The automatic valve 5 is signalled by the emptying mode to close conduit 10 to atmospheric pressure equilibrium (venting) and to open conduit 11 to atmospheric pressure equilibrium (venting), whereby the alternating tank 1 is closed to atmospheric pressure equilibrium (venting) and the alternating tank 2 is opened to atmospheric pressure equilibrium (venting). The probe 15 is disposed horizontally in the top part of the alternating tank 2 for preventing electrical contact release to the relay 38 when the liquid level in the alternating tank 1 is below the reach of the probe 13 and the liquid level in the liquid flow control tank 21 is in contact with the probe 27 to thereby allow the liquid level in the liquid flow control tank 21 to be lowered to the predetermined operating level and discontinue the holding signal. The probe 14 is given control of the relay 38 and normal filling and emptying mode cycle is continued.

The liquid may be continuously cycled in the above manner, or the vapor pressure may be used for other purposes or wasted, so long as the liquid is replaced to the storage tank 26 from the source of liquid by means of the input conduit 49 and the float valve 50.

It is to be understood that the above-described arrangements are only illustrative of the applications of the principles of the present invention. Numerous modifications and alternative arrangements may be devised by those skilled in the art without departing from the spirit and scope of the present invention and the appended claims are intended to cover such modifications and arrangements.

What is claimed is:

1. For use with heat exchanging systems having a source of heat, an improved fluid delivering system and apparatus comprising a heat exchanger which is in flow communication with the source of heat;

a pressure driven turbine generator which is in flow communication with the heat exchanger;

a vapor condensing means for converting the vaporous exhaust from the pressure driven turbine generator into the liquid state at normal atmospheric pressures and temperatures;

a source of fluid in the liquid state capable of being converted from the liquid state into the vapor state by the heat exchanger;

a storage tank for receiving the liquid from the source of fluid;

conduit means for delivering the liquid condensate from the condensing means into the storage tank, said conduit means being provided with a short venting conduit attached thereto at a convenient location;

alternating tank means for receiving liquid from the bottom part of the storage tank while, at the same time venting vapor into the top part of the said storage tank while being in a filling mode, and, alternately, delivering liquid from the bottom part of the said alternating tank means into the top part of a liquid flow control tank while, at the same time, receiving high pressure vapor from the heat exchanger into the top part of the said alternating tank while being in an emptying mode;

a liquid flow control tank means for receiving liquid from the bottom part of the alternating tank means and vapor from the top part of the heat exchanger, and for controlling the rate of liquid input such that the rate of liquid input is equal to the volume of liquid being vaporized by the heat exchanger;

conduit means for delivering liquid from the storage tank into the alternating tanks and, for delivering vapor from the alternating tanks into the storage tank;

conduit means for receiving high pressure vapor from the heat exchanger to thereby provide for high pressure vapor equilibrium between the liquid flow control tank, the heat exchanger and the alternating tank being emptied;

conduit means for delivering liquid from the alternating tanks into the liquid flow control tank, said conduit being attached to the bottom part of each alternating tank and to the top part of the liquid flow control tank and a check valve disposed in said conduit means below each said alternating tank to provide against liquid return into, the bottom of the said tank;

a first automatic valve means disposed in the liquid delivering conduit between the storage tank and the alternating tanks such that the top part (inlet) of the automatic valve is disposed in the conduit for delivering liquid from the bottom part of the storage tank and a normally closed outlet of the said valve is coupled to a branch of the said conduit being attached to the top of the first alternating tank and a normally opened outlet of the said valve is coupled to a branch of the said conduit being attached to the top of the second alternating tank;

a second automatic valve means disposed in the atmospheric pressure equilibrium conduit between the top part of the storage tank and the top part of the alternating tanks such that the top (inlet) part of the said automatic valve is in communication with the top part of the storage tank, and a normally closed outlet of the said valve is coupled to a branch of the said conduit being attached to the top part of the first alternating tank, and a normally opened outlet of the said valve is coupled to a branch of the said conduit being attached to the top part of the second alternating tank;

conduit means for providing flow communication between the top part of the heat exchanger means and the top part of the alternating tanks such that high pressure vapor equilibrium in said heat exchanger can communicate between the liquid flow control tank, the heat exchanger and the alternating tank being emptied;

a third automatic valve means disposed in the high pressure vapor equilbrium conduit between the heat exchanger means and the alternating tanks such that the top (inlet) part of the said third automatic valve is in communication with the source of high pressure vapor equilibrium and a normally opened outlet of the said valve is coupled to a branch of the said conduit being attached to the top part of the first alternating tank and a normally closed outlet of the said valve is coupled to a branch of the said conduit being attached to the top part of the second alternating tank;

liquid level detecting probe sensor means for detecting a filled condition and an empty condition, disposed in the first alternating tank means for completing a electric circuit whereby signals are delivered to an electrical control apparatus having a relay and an on-off switch for controlling the automatic valves such that a first probe sensor is disposed horizontally in the side of the said tank means at a predetermined level wherein the tank is considered to be filled and a second probe sensor is disposed vertically in the top of the said tank and is of a length that traverses the said tank downward to a predetermined level wherein the tank is considered to be empty and a third probe sensor disposed horizontally in the side of the tank and below the reach of the second probe sensor whereby, when the tank is filled, and the first probe sensor is contacted with liquid, a signal is delivered to the relay to reverse the positions of the said first, second and third automatic valves whereby the first alternating tank is placed into an emptying mode and whereby the first automatic valve is closed to liquid input into the first alternating tank, and the second automatic valve is closed to atmospheric pressure equilibrium with the storage tank and the third automatic valve is opened to high pressure vapor equilibrium input, with all positions being in regards to the first alternating tank, and at the same time, the opposite mode (or emptying position) is applied to the second alternating tank, and the emptying mode signal to the relay is maintained by the second (vertical) probe sensor until the said tank is emptied and the liquid level is lowered below the reach of the second probe sensor whereby the signal is again reversed by the relay and the automatic valves are so reversed and the third, horizontally disposed, probe sensor maintains the signal to the relay to contact the automatic valves to thereby cause the first automatic valve to open to liquid input into the first alternating tank and to open to atmospheric equilibrium between the first alternating tank and the storage tank and to close to high pressure vapor equilibrium input to the said first alternating tank whereby the first alternating tank is filled and the second alternating tank is emptied and the alternating cycle is continued;

conduit means for interconnecting the lower part of the alternating tanks with the top part of the liquid flow control tank, including check valve means disposed in said conduit means below each of the alternating tanks and above a point where the conduit from each said tank is joined to provide for a single conduit attachment to the top of the said liquid flow control tank;

conduit means for interconnecting the top part of the liquid flow control tank to the top part of the heat exchanger for high pressure vapor equilibrium communication between the said liquid flow control tank and the heat exchanger;

conduit means for interconnecting the bottom part of the liquid flow control tank with the bottom part of the heat exchanger to thereby maintain liquid equilibrium between the liquid flow control tank and the heat exchanger;

conduit means for interconnecting the high pressure vapor outlet of the heat exchanger with the pressure driven turbine, the liquid flow control tank and the alternating tanks;

a probe sensor disposed horizontally in the side of the second alternating tank for detecting a filled level of liquid in the second alternating tank for operating to signal the relay to maintain a filling mode to the second alternating tank when the first alternating tank is empty and the liquid level in the liquid flow control tank is above the desired level and in contact with the probe sensor disposed in the top part of the said tank such that the liquid contact completes a circuit to the on-off valve disposed in the conduit for delivering high pressure vapor equilibrium to the alternating tanks thereby causing the said valve to close and deny pressure to the said tanks until such time as the liquid level in the liquid flow control tank is lowered to a level below the reach of the probe sensor therein and the circuit is broken and the relay is released to continue normal alternating conditions;

conduit means for interconnecting the storage tank with the source of liquid;

float valve means for regulating the rate of liquid input from the source of liquid and for establishing and maintaining a desired liquid level in the storage tank such that, when a given volume of liquid is lost by the alternating venting process the float valve means opens to admit replacement liquid from the source of liquid to re-establish the desired liquid level.

2. An improved fluid delivering system in accordance with claim 1 wherein the liquid flow control tank means includes a holding tank, for receiving liquid from the alternating tank means and whereby the said liquid is maintained at a predetermined level therein and, for receiving vapor pressure from the heat exchanger, whereby the said vapor is held in the upper part of the said holding tank above the liquid;

an inlet conduit for receiving said liquid from the alternating tanks disposed in the top part of the liquid flow control tank;

an inlet conduit for receiving high pressure vapor from the heat exchanger;

an articulated float valve means disposed in the top part of the liquid flow control tank for operating to restrict liquid input from the liquid inlet when the liquid level has reached a preset high level and for operating to increase liquid input from said inlet when the liquid level is below the preset high level in said holding tank, in direct proportion to the amount of liquid being converted into vapor by the heat exchanger;

an electrically activated, level sensing high temperature probe sensor means for operating to detect a liquid level being above a desired preset liquid level and to thereby complete an electrical circuit whereby liquid input into the said holding tank is discontinued until the liquid is lowered below the reach of said probe sensor;

an outlet conduit disposed in the bottom part of the said holding tank for delivering liquid from the said holding tank into the heat exchanger;

continuous high pressure vapor equilibrium with the heat exchanger, and continuous liquid level equilibrium with the heat exchanger.

3. An improved system and method of introducing low pressure fluids into a high pressure heat exchanger wherein the method includes the following steps:

delivering a fluid in the liquid state into a storage tank wherein atmospheric pressure equilibrium exists;

delivering the liquid from the storage tank into alternating tanks, under alternating conditions;

delivering atmospheric pressure equilibrium between the storage tank and the alternating tank being filled;

providing elevation differential between the storage tank and the alternating tanks such that the liquid in the storage tank can flow into the alternating tanks, under alternating conditions, when the alternating tank being filled is in opened conduit communication with the storage tank wherein one opened conduit provides atmospheric pressure equilibrium between the storage tank and the said tank being filled and a second opened conduit provides liquid access to the lower said tank from the storage tank;

delivering high pressure vapor equilibrium to the alternating tank being emptied while, at the same time, isolating the said tank from atmospheric pressure equilibrium with the storage tank;

isolating the emptying alternating tank from liquid communication with the storage tank;

automatically switching the alternating tanks from a filling mode to an emptying mode such that while one said tank is filling the other said tank is emptying;

providing elevation differential between the alternating tanks and a lower disposed liquid flow control tank;

delivering liquid from the filled alternating tank into the lower disposed liquid flow control tank while, at the same time, delivering liquid from the storage tank into the lower disposed emptied alternating tank;

providing high pressure vapor equilibrium between the liquid flow control tank and the alternating tank that is delivering liquid into the said liquid flow control tank;

regulating the liquid input from the emptying alternating tank into the liquid flow control tank by means of an articulated float valve disposed in the top part of the said control tank;

disposing check valves in the delivering conduits between the alternating tanks and the liquid flow control tank such that, when the emptying alternating tank is closed to liquid input into the liquid flow control tank by the float valve disposed therein, the liquid is prevented from entering the other alternating tank by means of the said check valves;

disposing the liquid flow control tank at such an elevation that the average maintained liquid level therein is equal to the average liquid level desired in the heat exchanger;

delivering liquid from the liquid flow control tank into the heat exchanger through permanently opened interconnecting conduit at a rate equal to the rate of liquid conversion into vapor within the heat exchanger;

providing high pressure vapor equilibrium communication between the liquid flow control tank and the heat exchanger through permanently opened interconnecting conduit being attached to the top part of each said tank and exchanger;

delivering the high pressure vapor produced by the heat exchanger into dispensing conduit for use by the alternating tanks and a pressure driven turbine generator and a vapor condensing means.

* * * * *